United States Patent [19]

Jentof et al.

[11] Patent Number: 4,757,852

[45] Date of Patent: Jul. 19, 1988

[54] AUTOMATIC MOSQUITO CURTAIN FOR WINDOWS AND DOORS

[76] Inventors: Leon Jentof, Rua Sao Vincente De Paula, 635, Conj, 71, Sao Paulo, Brazil; Primo Bonici, 15 Manson Dr., Old Westbury, N.Y. 11568; Leonardo E. Jentof, Bergana 1660, Cep., 1718, San Antonió De Pauva B.S., Argentina

[21] Appl. No.: 922,053

[22] Filed: Oct. 22, 1986

[30] Foreign Application Priority Data

Oct. 25, 1985 [AR] Argentina ..... 302.068

[51] Int. Cl.[4] ..... E06B 9/54

[52] U.S. Cl. ..... 160/23.1; 160/290.1

[58] Field of Search ..... 160/23 R, 23 C, 31, 160/271, 280, 281, 290 R, 290 F, 313, 315

[56] References Cited

U.S. PATENT DOCUMENTS

| | | | |
|---|---|---|---|
| 1,766,730 | 6/1930 | Traut | 160/290 R |
| 1,766,746 | 6/1930 | Heckman | 160/23 R X |
| 1,934,103 | 11/1933 | Traut | 160/23 R |
| 1,937,209 | 11/1933 | Traut | 160/315 X |
| 2,520,618 | 8/1950 | Winter | 160/315 |
| 2,696,249 | 12/1954 | Prokop et al. | 160/315 |
| 4,398,585 | 8/1983 | Marlow | 160/290 R X |
| 4,399,855 | 8/1983 | Volfson | 160/290 R X |
| 4,429,729 | 2/1984 | Winslow | 160/315 |

*Primary Examiner*—Ramon S. Britts
*Assistant Examiner*—David M. Purol
*Attorney, Agent, or Firm*—McGlew and Tuttle

[57] ABSTRACT

A spindle which is rotatably mounted in a box-like housing rotatably carries a tube. A spring is connected between the tube and spindle to exert a biasing rolling force on the tube. A stop member holds the spindle fixed with respect to the housing to permit rolling of the tube. An upper edge of a mesh screen is fixed to the tube so that the screen can be rolled up on the tube. Lateral channel shaped guide members extend downwardly from the housing and guide edges of the screen. A fastening member is connected to a lower edge of the screen and includes moveably mounted pins which are engageable into recesses in the guide members to hold the fastening member down and cover an area with the screen. The housing can be mounted over a window or door so that the screen can be pulled down over the opening of the window or door.

9 Claims, 2 Drawing Sheets

AUTOMATIC MOSQUITO CURTAIN FOR WINDOWS AND DOORS

FIELD AND BACKGROUND OF THE INVENTION

The present invention relates principally to a mosquito curtain for windows and/or doors that rolls up automatically In practice, the method conventionally used to prevent flying insects from entering dwelling areas, whenever the windows and/or doors might allow it, is to removably mount conventional frames bearing wire screen in the openings of the said windows or to mount them on hinges on the jamb or frame of the doors.

In contrast to these screens, which actually constitute fixed window panes or movable, supplementary door panels, respectively, the new mosquito curtain offers the advantage of taking up space only when it is needed for use, and when unused can simply be rolled up to a higher position that does not interfere with the corresponding window panes and/or doors that must accommodate it.

SUMMARY OF THE INVENTION

In its essential aspect and shape, the invention comprises a mosquito curtain made of a mesh screen associated with an automatic rolling device above it which can be mounted under the lintel of the window or door opening and on the inside of its corresponding panes or panels. The curtain is moveable up and down, and has associated corresponding lateral guide members. It is equipped with a lower fastening end to hole the curtain in a lowered position for use.

Thus, a device is obtained that is easy and simple to mount and can, moreover, be operated without complicated maneuvers, with the aid of the various components provided for those purposes.

The automatic roll-up mosquito curtain for windows and/or doors is of the type whose functional element consists of a mesh screen, and it is characterized by having a roll-up device, lateral guide members and a lower fastening member. The roll-up device comprising a housing mountable on brackets underneath the lintel of the corresponding window and/or door opening and provided with a longitudinal aperture for entry and exit of said mesh screen attached in turn along one of the generating lines of a roll-up tube which is mounted inside said housing on a spindle turnably supported on the ends of said rolling tube. The housing contains a helicoidal torsion spring extended between an external operating knob and its own stop end piece and pulling in only one direction with respect to the inner surface of the tube. An external stop member which prevents turning, is on the opposite side from said knob on the corresponding end of the housing. Lateral guide members each consisting of channeled sections are mounted on the window and/or door jambs. The lower fastening member comprises a pair of plates that permanently hold the corresponding end segment of the mesh screen and are equipped with end pieces with respective pins that are opposed by means of corresponding compression springs and have an operating screw each projecting through respective slots provided in the front plate of the rastening member. Free ends of the pins extend through corresponding holes located in each plate, on the lateral surface of respective vertical recesses each coinciding with gripping teeth in each guide member.

In order to make the present invention easier to understand, it is described in more detail below with reference to the preferred embodiment presented by way of illustration and not of limitation and depicted in the accompanying drawings.

DESCRIPTION OF THE PREFERRED EMBODIMENTS

In these drawings, use of the same reference symbols indicates parts that are the same or analogous.

As the drawings show, the mosquito curtain pursuant to the present invention consists of a mesh sheet a associated with an automatic rolling device b above, provided with guide members c and d on the sides, and equipped with fastening member e below, which acts in conjunction with said guide member c and d.

Figure 1:
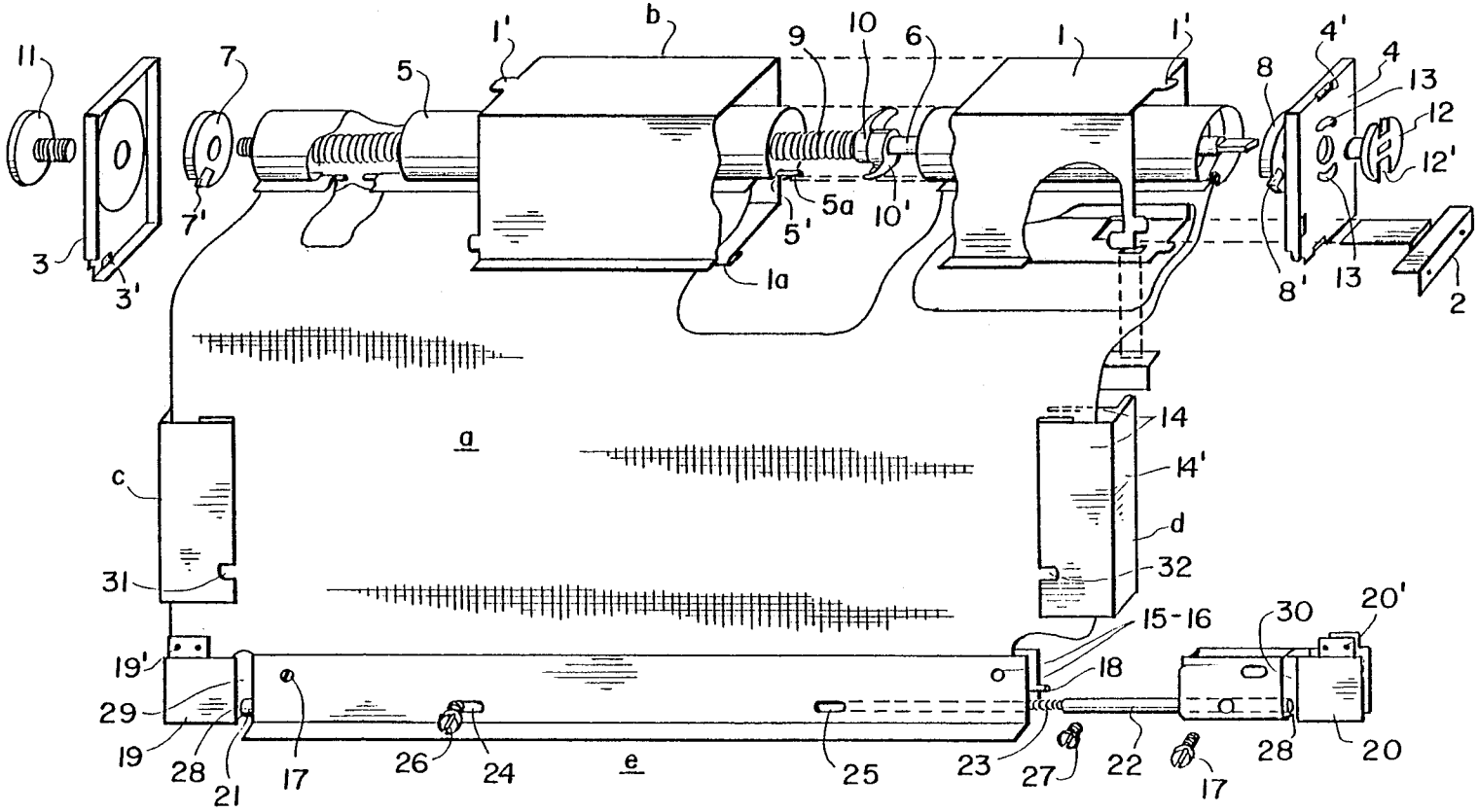
FIG. 1 is a perspective view of the invented mosquito curtain partially assembled with a cut-away view of the guide members.
Figure 3:
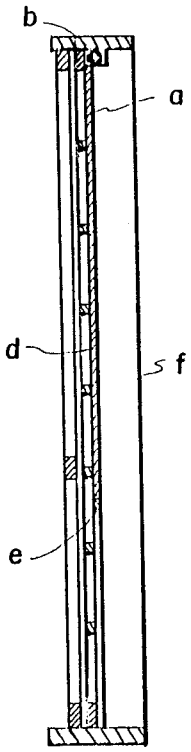
FIG. 3 shows the window in sectional view along line III—III in FIG. 2.
Figure 2:
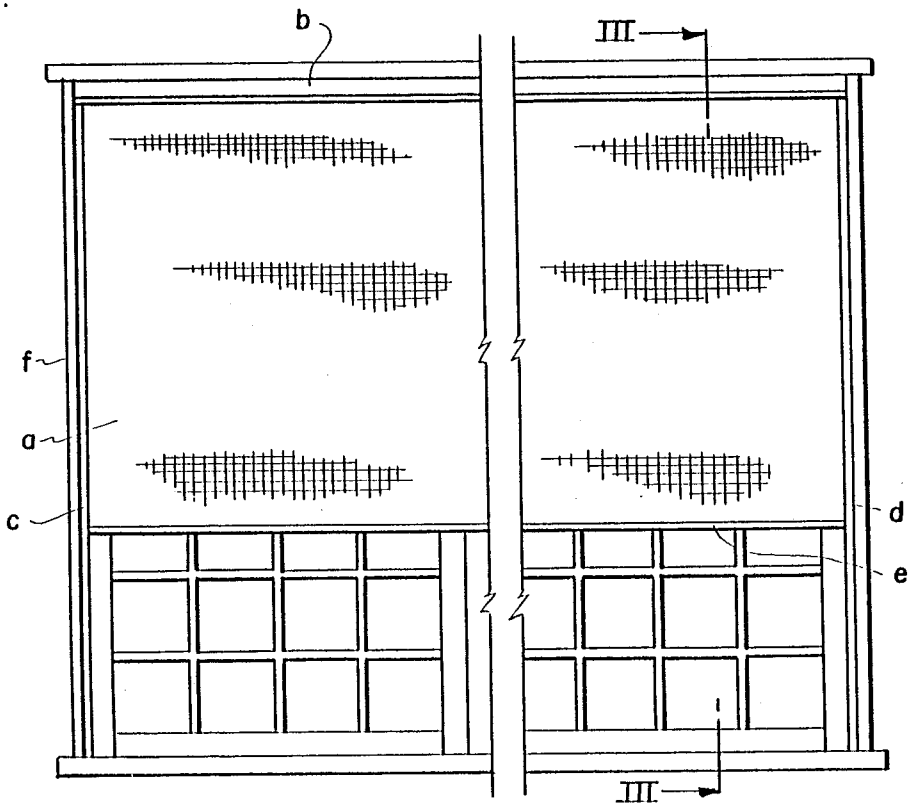
FIG. 2 is another view showing in elevation and from the inside a window provided with said mosquito curtain.

The automatic rolling device b, suitable for mounting under the lintel of a conventional window like that illustrated in FIGS. 2 and 3 and indicated by the general reference symbol f, or that of a door, comprises a prismatic housing 1 (FIG. 1) with longitudinal aperture 1*a* for the screen a, attached to the jamb or casing of the window by means of end brackets 2, its own ends being fastened by means of respective caps 3 and 4 which in turn have slots 3' and 4' that interact with the mounting lugs 1' projecting from the end edges of the housing 1.

In the inside of the housing 1 is a cylindrical rolling tube 5 turnably mounted on a spindle 6 and provided along one of its generating lines with a groove 5' to receive the upper edge of the mesh screen a and to adjust and retain it with the aid of a bar 5*a*.

The mounting of the rolling tube 5 on the spindle 6 is achieved by means of a pair of small support discs 7 and 8 with their respective radial cut-outs 7' and 8' corresponding to the recess defined by the surface of the channel 5', said discs being set into the ends of the tube.

The spindle 6 projects through the housing caps 3 and 4 and bears wrapped around it the helicoidal torsion spring 9 and extends from the disc 7 to the unidirectional pulling end 10 positioned inside the tube 5 and equipped in order to perform that function with pulling arms 10'. On its extreme segment projecting through housing cap 3, the spindle 6 has an operating knob 11, and on its other end, also projecting through housing cap 4 it has a stop member 12 to prevent rotation that interacts by means of its diametrically opposed notches 12' with the lugs 13 provided on the housing cover 4.

The guide members c and d are mounted on the respective jambs or side posts of the frame or casing of the window f and in each case consist of parallel wing sections 14 with flanged edges, with a web 14' extending into a mounting lug.

The fastening member e finally, consists of a pair of plates 15 and 16 that are held facing each other by means of screws 17 and define a longitudinal space for receiving the lower edge of the mesh screen a, including a retaining bar 18 when appropriate. On the ends, the fastening member e incorporates end pieces 19 and 20, equipped with lugs 19' and 20' for attaching to said mesh screen a, and in addition in each case for guiding the displacement of respective fastening pins 21 and 22, which in turn, counterpoised by an associated compression spring 23, run between the pair of plates 15 and 16 already described.

Each of the fastening pins 21 and 22, via respective slots 24 and 25 provided in the front plate 15, are controlled by operating screw 26 and 27, so that their corresponding free ends each emerge through holes 28 in vertical recesses 29 and 30 in each end piece 19 and 20, to correspond with respective retaining teeth 31 and 32 provided in each guide member c and d at the corresponding level and accomplish the fastening of the mesh screen a in its unrolled state. It should be pointed out that when rolled up, the screen will have its closing member c come to a stop against the lower face of the housing 1 that is part of the automatic roll-up device b.

Before the mosquito curtain is installed, in order for it to function as it should, the torsion spring 9 must be tensioned by turning the knob 11 that acts on the spindle 6 it is mounted on, and then be locked into position by means of the stop member 12.

With the spring thus loaded, its own stop end piece, when turned by means of its diametrically opposed arms 10', forces the tube 5 to turn in the direction of roll-up, while the arms 10', in the unrolling direction, let the tube 5 turn freely.

It is noted that the arms 10' on pulling end 10 are pivotly mounted to the spindle 6 and are fixed to the end of spring 9. They are hooked shaped so that they permit rotation of tube 5 only in a direction off the ends of the hooks. Rotation of tube 5 in a direction toward the hooks is precluded as the hooks rotate out and jam against the inner surface of the tube 5.

The opposite end of spring 9 is fixed to the knob 11 thereby permitting the spring to be "wound". This biases the tube to rotate in a direction to raise the screen a. Raising of the screen is precluded however when the ends of pins 21 and 22 are in the teeth or recesses 31 and 32 of the guide members c and d.

By moving the screws 26 and 27 toward each other in their respective slots 24 and 25, and against the biasing of their springs 23, this disengages the ends of pins 21 and 22 from the recesses 31 and 32 permitting the screen to be rolled up on the tube 5 as the tube 5 rotates under the influence of spring 9.

It is also noted that knob 11 can be used not only to rotate the spindle 6 but also to move it axially to a certain extent within the housing 1. This axial movement permits the stop member 12 to be moved to the right in FIG. 1 to avoid contact with the lugs 13 and to permit rotation of the spindle. The knob can then be pulled to the left thereby pulling the stop 12 to the left and engaging the notches 12' with the lugs 13.

While the specific embodiment of the invention has been shown and described in detail to illustrate the application of the principles of the invention, it will be understood that the invention may be embodied otherwise without departing from such principles.

What is claimed is:

1. An automobile roll-up mosquito curtain for windows and doors comprising:

a housing having a longitudinal aperture and adapted to be connected near the top of windows and doors;

a spindle rotatably mounted in said housing having opposite ends extending out of said housing;

a roll-up tube rotatably mounted to said spindle in said housing;

a mesh screen having an upper edge attached to said tube and extending through said longitudinal aperture so as to be rollable on said tube, said mesh screen having side edges and a lower edge;

a pair of spaced apart longitudinal guide members extending dowwardly from said housing in opposite sides of said housing, each guide members having a channel which is open toward the other guide member, said side edges of said mesh screen adapted for riding upwardly and downwardly in said channels of said guide members;

a lower fastening member fixed to said lower edge of said mesh screen;

a pair of pins slideably mounted in said fastening member each pin being slideable to extend outwardly from one end of said lower fastening member;

a pin spring engaged with each pin for biasing each pin outwardly with respect to said fastening member;

each guide member including a recess near a lower end thereof for receiving one of said pins for retaining said fastening member in a lowered position with respect to said housing so that said mesh screen extends between said guide members and between said housing and said fastening member; and roll-up spring means operatively connected between said spindle and said tube for rolling said tube with respect to said spindle to roll said screen onto said tube when said pins are disengaged from said recesses to permit rising of said fastening member with respect to said guide members, said roll-up spring means comprising a helicoidal torsion spring engaged over said spindle and having opposite ends, a knob fixed to one end of said spindle and fixed to one end of said torsion spring, said knob being rotatably mounted with respect to said housing and disposed outside of said housing, a pulling member fixed to the opposite end of said spring and engageable with said tube for engaging said tube so that rotation of said pulling member due to rotation of said opposite end of said spring causes rotation of said tube on said spindle, and a stop member fixed to an opposite end of said spindle from said knob, said stop member being external of said housing and being engageable with a portion of said housing for stopping rotation of said spindle.

2. A mosquito curtain according to claim 1 wherein said housing includes removable end caps covering opposite ends of said housing and to which said spindle is rotatably mounted.

3. A mosquito curtain according to claim 2 including at last one lug extending outwardly from said cap which is adjacent said stop member, said stop member having a notch for engaging said lug to stop rotation of said spindle with respect to said housing.

4. A mosquito curtain according to claim 3 wherein said stop member includes a pair of diametrically opposed notches, said cap including a pair of spaced apart lugs extending therefrom each engageable with one of said notches.

5. An automatic roll-up mosquito curtain for windows and doors comprising:

a housing having a longitudinal aperture and adapted to be connected near the top of windows and doors;

a spindle rotatably mounted in said housing having opposite ends extending out of said housing;

a roll-up tube rotatably mounted to said spindle in said housing;

a mesh screen having an upper edge attached to said tube and extending through said longitudinal aperture so as to be rollable on said tube, said mesh screen having side edges and a lower edge;

a pair of spaced apart longitudinal guide members extending downwardly from said housing in opposite sides of said housing, each guide members having a channel which is open toward the other guide member, said side edges of said mesh screen adapted for riding upwardly and downwardly in said channels of said guide members;

a lower fastening member fixed to said lower edge of said mesh screen;

a pair of pins slideably mounted in said fastening member each pin being slideable to extend outwardly from one end of said lower fastening member;

a pin spring engaged with each pin for biasing each pin outwardly with respect to said fastening member;

each guide member including a recess near a lower end thereof for receiving one of said pins for retaining said fastening member in a lowered position with respect to said housing so that said mesh screen extends between said guide members and between said housing and said fastening member; and roll-up spring means operatively connected between said spindle and said tube for rolling said tube with respect to said spindle to roll said screen onto said tube when said pins are disengaged from said recesses to permit rising of said fastening member with respect to said guide members, said roll-up spring means comprising a helicoidal torsion spring engaged over said spindle and having opposite ends, a knob fixed to one end of said spindle and fixed to one end of said torsion spring, said knob being rotatably mounted with respect to said housing and disposed outside of said housing, a pulling member fixed to the opposite end of said spring and engageable with said tube for engaging said tube so that rotation of said pulling member due to rotation of said opposite end of said spring causes rotation of said tube on said spindle, and a stop member fixed to an opposite end of said spindle from said knob, said stop member being external of said housing and being engageable with a portion of said housing for stopping rotation of said spindle, said housing including removable end caps covering opposite ends of said housing and to which said spindle is rotatably mounted, including at least one lug extending outwardly from said cap which is adjacent said stop member, said stop member having a notch for engaging said lug to stop rotation of said spindle with respect to said housing, said stop member including a pair of diametrically opposed notches; said cap including a pair of spaced apart lugs extending therefrom each engageable with one of said notches, said pulling member comprising a pair of hook shaped turning arms rotatably mounted to said spindle and fixed to said opposite end of said spring, each arm being engageable with an inside surface of said tube for permitting rotation of said tube in one direction and for blocking rotation of said tube in the opposite direction.

6. A mosquit curtain according to claim 5 wherein said pulling member comprises a pair of hook shaped turning arms rotatably mounted to said spindle and fixed to said opposite end of said spring, each arm being engageable with an inside surface of said tube for permitting rotation of said tube in one direction and for blocking rotation of said tube in the opposite direction.

7. A mosquito curtain according to claim 5 wherein said housing includes at least one lug extending outwardly therefrom adjacent said stop member, said stop member having at least one notch therein engageable with said lug for blocking rotation of said spindle with respect to said housing.

8. A mosquito curtain according to claim 5 wherein said fastening member includes a pair of end plates connected to opposite ends thereof, each end plate being slideably mounted in one of said guide members for upward and downward movement, each pin being slideable adjacent each respective end plate.

9. A mosquito curtain according to claim 8 wherein said fastening member comprises a pair of plates connected to each other and having said lower edge of said screen there between, one of said plates having a pair of spaced apart slots therein, a screw connected to each pin and moveable in one of said slots, said screws being moveable toward and away from each other for disengaging and engaging said pins with their respective recesses.

* * * * *